US005440464A

United States Patent [19]

Nowlin et al.

[11] Patent Number: 5,440,464

[45] Date of Patent: Aug. 8, 1995

[54] LIGHT SHROUD FOR HIGHWAY SIGNS

[76] Inventors: Richard R. Nowlin, 18381 Old Coast Hwy., Ft. Bragg, Calif. 95437; Lewis O. Wing, Box 785, Salem, Ark. 72576

[21] Appl. No.: 316,631

[22] Filed: Sep. 30, 1994

[51] Int. Cl.[6] ..... F21V 7/00

[52] U.S. Cl. ..... 362/190; 362/109; 40/546; 40/555; 340/321; 340/908

[58] Field of Search ..... 362/109, 190, 812, 186, 362/183; 40/541, 542, 550, 551, 546; 340/473, 321, 908, 906

[56] References Cited

U.S. PATENT DOCUMENTS

| | | | |
|---|---|---|---|
| D. 300,374 | 3/1989 | Dziurman | D26/68 |
| D. 303,017 | 8/1989 | Flores | D26/51 |
| 3,279,110 | 10/1966 | Lelicoff | 40/555 |
| 3,810,091 | 5/1974 | Hoover | 40/555 |
| 3,821,860 | 7/1974 | Patty | 40/555 |
| 4,042,919 | 8/1977 | Patty | 362/186 |
| 4,650,265 | 3/1987 | Holtzman | 339/1 L |
| 5,165,187 | 11/1992 | Shahidi-Hamedaniet | 40/547 |
| 5,276,424 | 1/1994 | Hegemann | 362/109 |

*Primary Examiner*—James C. Yeung
*Attorney, Agent, or Firm*—Richard L. Miller

[57] ABSTRACT

A light shroud for a highway sign comprising a hand held sign having a panel with an indicia display thereon. A handle extends downwardly from a bottom edge of the panel. A person can grip the handle and hold up the panel to display the indicia thereon. An easy removable structure is attachable about the perimeter of the panel for illuminating the indicia upon the panel.

3 Claims, 1 Drawing Sheet

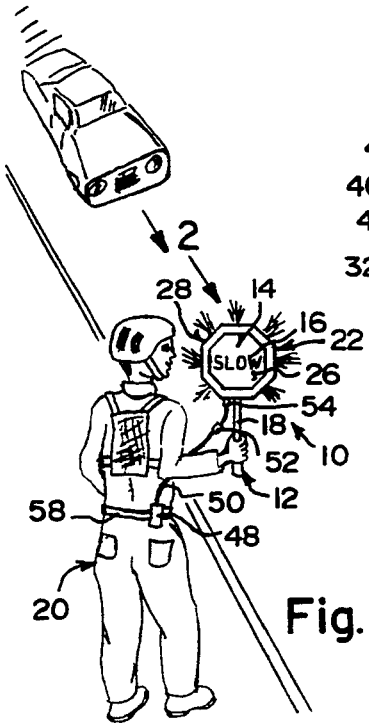
Fig. 1
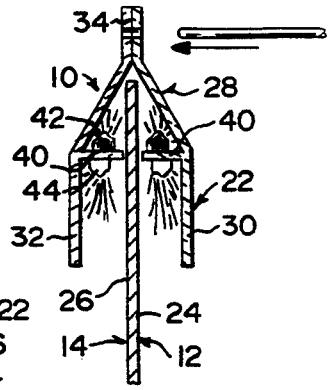
Fig. 3
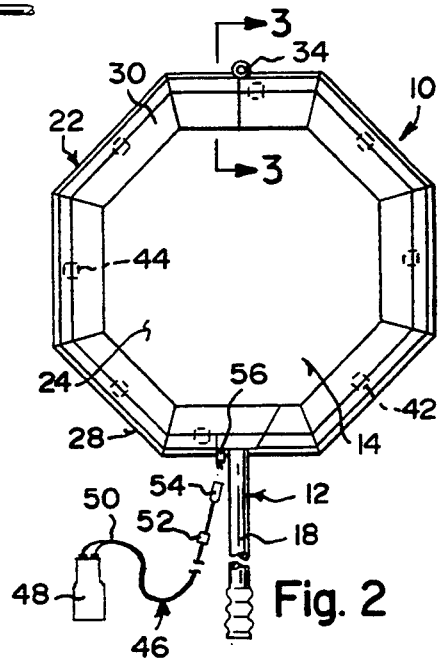
Fig. 2
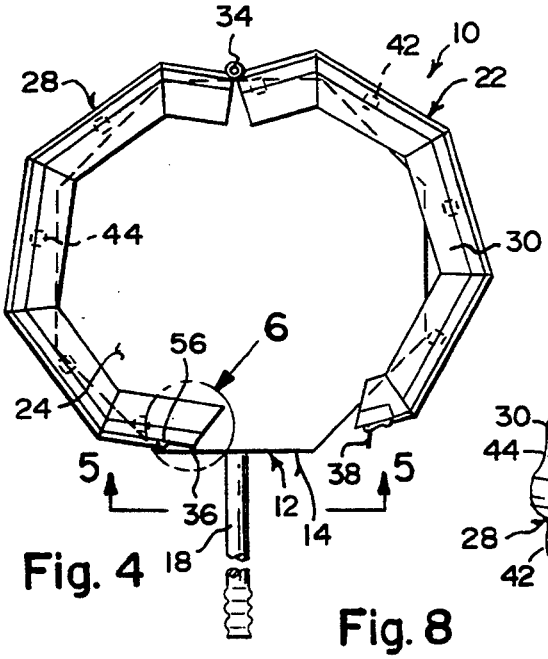
Fig. 4
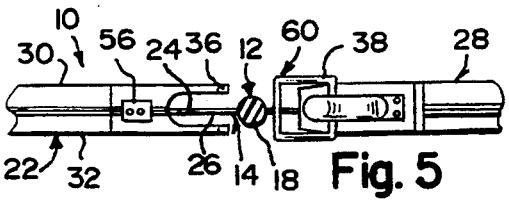
Fig. 5
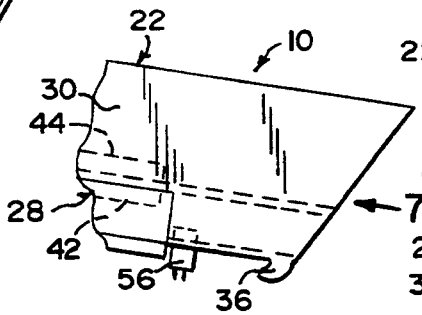
Fig. 6
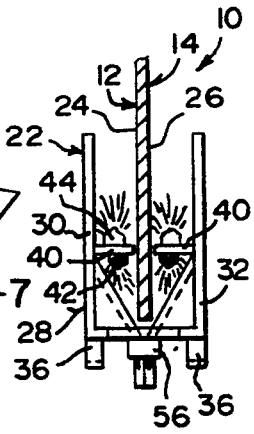
Fig. 7
Fig. 8
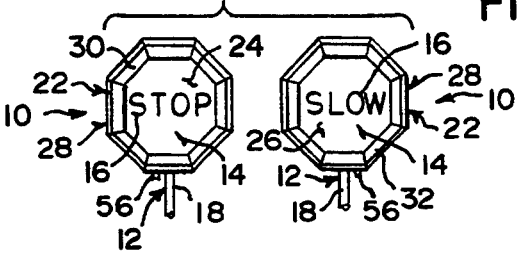

LIGHT SHROUD FOR HIGHWAY SIGNS

BACKGROUND OF THE INVENTION

The instant invention relates generally to illuminated signs and more specifically it relates to a light shroud for a highway sign.

Numerous illuminated signs have been provided in prior art that are adapted to include light sources to light up words, numbers and symbols, so that people may easily see them at night or in dark situations. For example, U.S. patents numbered U.S. Pat. No. 4,650,265 to Holtzman; 5,165,187 to Shahidi-Hamedani et al.; Des. 300,374 to Dziurman and Des. 303,017 to Flores all are illustrative of such prior art. While these units may be suitable for the particular purpose to which they address, they would not be as suitable for the purposes of the present invention as heretofore described.

SUMMARY OF THE INVENTION

A primary object of the present invention is to provide a light shroud for a highway sign that will overcome the shortcomings of the prior art devices.

Another object is to provide a light shroud for a highway sign that will produce illumination for hand held signs for flag person at highway construction sites during dark hours.

An additional object is to provide a light shroud for a highway sign in which the illumination lights and flashing lights will add to the safety of the construction workers and motorists passing by.

A further object is to provide a light shroud for a highway sign that is simple and easy to use.

A still further object is to provide a light shroud for a highway sign that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

The Figures on the drawings are briefly described as follows:

FIG. 1 is a diagrammatic perspective view of the instant invention in use;

FIG. 2 is an enlarged elevational view of the instant invention per se taken generally in the direction of arrow 2 in FIG. 1;

FIG. 3 is a cross sectional view with parts broken away taken on line 3—3 in FIG. 2;

FIG. 4 is an enlarged elevational view similar to FIG. 2 but with the instant invention partially open;

FIG. 5 is an enlarged cross sectional view with parts broken away taken on line 5—5 of FIG. 4;

FIG. 6 is a further enlarged view of the area in the dotted circle indicated by arrow 6 in FIG. 4;

FIG. 7 is an elevational view taken in the direction of arrow 7 in FIG. 6; and FIG. 8 is a diagrammatic elevational view illustrating typical indicia on both sides of the instant invention.

DETAILED DESCRIPTION OF THE PREFERRED EMBODIMENTS

Turning now descriptively to the drawings, in which similar reference characters denote similar elements throughout the several views, FIGS. 1 through 8 illustrate a light shroud for a highway sign 10 comprising a hand held sign 12 having a panel 14 with an indicia display 16 thereon. A handle 18 extends downwardly from a bottom edge of the panel 14. A person 20 can grip the handle 18 and hold up the panel 18 to display the indicia 16 thereon. A structure 22 is attached about the perimeter of the panel 14 for illuminating the indicia 16 upon the panel 14.

As shown in FIG. 8, the indicia 16 can include the word 'STOP' printed on one surface 24 of the panel 14 and the word 'SLOW' printed on an opposite surface 26 of the panel 14.

The illumination structure 22 consists of a cover 28 having a generally V-shaped configuration in cross section, with a pair of integral side walls 30, 32 and divided into two halves. A top hinge 34 is attached to the cover 28, so that the cover 28 can fit over the perimeter of the panel 14. The side walls 30 and 32 of the cover 28 are spaced away from the two surfaces 24 and 26 of the panel 14. A bottom latch mechanism 60 on the cover 28 is a hook 36 on one side and an engaging bail 38 on an opposite side, so that the cover 28 can be retained in place on the panel 14. A pair of flanges 40 are provided, with each extending from an inner surface of one side wall 30 and 32 of the cover 28 about the perimeter of the panel 14. A first series of lamps 42 are mounted to the inner surfaces of the flanges 40. A second series of lamps 44 are mounted to the outer surfaces of the flanges 40. An apparatus 46 is for supplying electricity to the lamps 42, 44, so that the lamps 42, 44 will light up the two surfaces 24, 26 of the panel 14.

The first side wall 30 of the cover 28 is transparent and red in color to match up with the surface 24 of the panel 14 having the word 'STOP' thereon. The second side wall 32 of the cover 28 is transparent and amber in color to match up with the surface 26 of the panel 14 having the word 'SLOW' thereon. The first series of lamps 42 are of a blinking type, while the second series of lamps 44 are of a steady-on type.

The electricity supply apparatus 46 includes a portable battery and flasher unit 48. An electrical cord 50 extends from 16 the portable battery and flasher unit 48. An on/off switch 52 is in the cord 50. A socket 54 is on a distal end of the cord 50. A plug 56 on the cover 28 is electrically connected to the lamps 42, 44, whereby the plug 56 will engage with the socket 54.

OPERATION OF THE INVENTION

During the night or dimly lit areas to use the easy removable light shroud with an accordingly mating highway sign 10, a person 20 can simply place the structure 22 about the panel 14 and engage the bottom latch mechanism 60. The portable battery and flasher unit 48 can be attached to a belt 58 worn by the person 20. The socket 54 is then engaged with the plug 56. The handle 18 is grasped by the person 20 and the switch 52 turned on. When lit the lamps 42 will be highly visible through the V-shaped portion of the cover 28 while the lamps 44 will illuminate the panel 14.

During the day light or well lit areas the structure 22 may be removed from the panel 14 an so the sign 12 will be accordingly lighter can be used alone with less encumbrances.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A light shroud for a highway sign comprising:

a) a hand held sign having a panel with an indicia display thereon and a handle extending downwardly from a bottom edge of said panel, so that a person can grip said handle and hold up said panel to display said indicia thereon, wherein said indicia can include the word 'STOP' printed on one surface of said panel and the word 'SLOW' printed on an opposite surface of said panel; and b) means attached about the perimeter of said panel for illuminating said indicia upon said panel, wherein said illumination means includes:

i) a cover having generally a V-shaped configuration in cross section, with a pair of side walls, and divided into two halves;

ii) a top hinge on said cover, so that said cover can fit over the perimeter of said panel with said side walls of said cover spaced away from said two surfaces of said panel;

iii) a bottom latch mechanism on said cover being a hook on one side and an engaging bail on an opposite side, so that said cover can be retained in place on said panel;

iv) pair of flanges, each extending from an inner surface of one said side wall of said cover about the perimeter of said panel;

v) a first series of lamps mounted to an inner surfaces of said flanges;

vi) a second series of lamps mounted to an outer surfaces of said flanges; and vii) means for supplying electricity to said lamps, so that said lamps will light up the two surfaces of said panel, and said V-shaped configuration of said cover.

2. A light shroud for a highway sign as recited in claim 1, further including:

a) said first side wall of said cover being transparent and red in color to match up with said surface of said panel having the word 'STOP' thereon;

b) said second side wall of said cover being transparent and amber in color to match up with said surface of said panel having the word 'SLOW' thereon;

c) said first series of lamps are of a blinking type; and d) said second series of lamps are of a steady-on type.

3. A light shroud for a highway sign as recited in claim 2, wherein said electricity supply means includes:

a) a portable battery and flasher unit;

b) an electrical cord extending from said portable battery and flasher unit;

c) an on/off switch in said cord;

d) a socket on a distal end of said cord; and e) a plug on said cover electrically connected to said lamps, whereby said plug will engage with said socket.

* * * * *